US005996501A

United States Patent [19]

Spencer et al.

[11] Patent Number: 5,996,501

[45] Date of Patent: Dec. 7, 1999

[54] BLAST AND FRAGMENTATION ENHANCING EXPLOSIVE

[75] Inventors: Arthur F. Spencer; John D. Corley, both of Niceville, Fla.

[73] Assignee: The United States of America as represented by the Secretary of the Air Force, Washington, D.C.

[21] Appl. No.: 09/148,906

[22] Filed: Aug. 27, 1997

[51] Int. Cl.[6] ..... F42B 1/00

[52] U.S. Cl. ..... 102/286; 102/289; 102/292; 102/473; 102/492; 149/46; 149/47; 149/57

[58] Field of Search ..... 102/286, 289, 102/473, 292, 472; 149/46, 47, 57

[56] References Cited

U.S. PATENT DOCUMENTS

| | | | |
|---|---|---|---|
| 3,561,361 | 2/1971 | Kessenich et al. | 102/307 |
| 3,742,859 | 7/1973 | Finnegan et al. | 102/101 |
| 3,978,796 | 9/1976 | Hackman | 102/67 |
| 4,424,086 | 1/1984 | Christopher | 102/286 X |
| 4,729,317 | 3/1988 | Burdette et al. | 102/292 X |
| 4,896,609 | 1/1990 | Betts et al. | 102/307 X |
| 5,243,916 | 9/1993 | Freche et al. | 102/481 |
| 5,313,890 | 5/1994 | Cuadros | 102/496 |
| 5,411,615 | 5/1995 | Sumrail et al. | 149/47 |
| 5,467,714 | 11/1995 | Lund et al. | 102/289 X |
| 5,509,357 | 4/1996 | Lawther | 102/307 |
| 5,544,589 | 8/1996 | Held | 102/492 |
| 5,690,867 | 11/1997 | Nouguez et al. | 264/3.1 |
| 5,847,312 | 12/1998 | Walters et al. | 102/309 |

*Primary Examiner*—Peter A. Nelson
*Attorney, Agent, or Firm*—Bobby D. Scearce; Thomas L. Kundert

[57] ABSTRACT

A dual explosive charge is described that simultaneously enhances blast and fragmentation characteristics of the charge, including an inner driven charge of a non-ideal explosive surrounded by an outer charge sleeve of a more nearly ideal explosive, detonation of the outer charge resulting in an extremely high temperature, high pressure environment that accelerates reaction kinetics in the inner charge, resulting in enhanced blast and fragmentation performance of the explosive charge.

15 Claims, 7 Drawing Sheets

BLAST AND FRAGMENTATION ENHANCING EXPLOSIVE

RIGHTS OF THE GOVERNMENT

The invention described herein may be manufactured and used by or for the Government of the United States for all governmental purposes without the payment of any royalty.

BACKGROUND OF THE INVENTION

The present invention relates generally to explosive charge formulations and configurations and more particularly to a dual explosive charge formulation and configuration for enhancing blast pressure and fragmentation in a munition.

Previously existing customized explosives used for enhancing the blast or fragmentation characteristics of munitions have primarily been based on features of a target or set of targets. Blast performance is compromised in order to obtain high velocity fragments from very brisant or nearly ideal explosives (i.e., binders with nitramines). Fragmentation performance is compromised in order to obtain enhanced blast characteristics by replacing a portion of the nitramines with oxidizers and/or metal powders in non-ideal explosives. Total energy theoretically achievable from the non-ideal formulations is seldom realized experimentally. The rate of energy release from these formulations is relatively slow and many of the reactions occur relatively late compared with more nearly ideal explosives.

The invention solves or substantially reduces in critical importance problems with conventional explosive charge formulations and configurations by providing a dual explosive charge that simultaneously enhances blast and fragmentation characteristics in munition systems that commonly employ high explosive charges. The dual charge of the invention includes a cylindrical inner driven charge of a non-ideal explosive containing an inter-molecular composite mixture which includes fuels and/or oxidizers such as metal powders and/or oxidizers with a near stoichiometric blend of intra-molecular fuel ingredients such as trinitrotoluene. The inner charge is surrounded by an outer charge sleeve of a more nearly ideal explosive. Detonation of the outer charge results in super-confinement and/or shock pressure over-driving the inner charge and extremely high temperature, high pressure environment that accelerates the reaction kinetics for the inner charge, thereby allowing more reaction products to be formed earlier than for an unconfined charge of the same composition. With the proper inner-charge diameter and outer charge thickness, the outer charge maintains the fragment acceleration characteristics of a charge containing only the outer charge composition and allows blast performance to be enhanced while maintaining fragmentation performance by accelerating the reaction rate of the non-ideal explosive.

It is therefore a principal object of the invention to provide an improved explosive charge.

It is a further object of the invention to provide an explosive charge configuration having optimum blast pressure and fragmentation characteristics.

It is a further object of the invention to provide an explosive charge configuration having enhanced blast and fragmentation performance by accelerating the reaction rate of the explosive.

It is another object of the invention to provide an explosive charge for enhancing the performance of blast and fragmentation warheads and deep earth penetrating munitions.

These and other objects of the invention will become apparent as a detailed description of representative embodiments proceeds.

SUMMARY OF THE INVENTION

In accordance with the foregoing principles and objects of the invention, a dual explosive charge is described that simultaneously enhances blast and fragmentation characteristics of the charge, including an inner driven charge of a non-ideal explosive surrounded by an outer charge sleeve of a more nearly ideal explosive, detonation of the outer charge resulting in an extremely high temperature, high pressure environment that accelerates reaction kinetics in the inner charge, resulting in enhanced blast and fragmentation performance of the explosive charge.

DESCRIPTION OF THE DRAWINGS

The invention will be more clearly understood from the following detailed description of representative embodiments thereof read in conjunction with the accompanying drawings wherein.

DETAILED DESCRIPTION

Figure 1A:
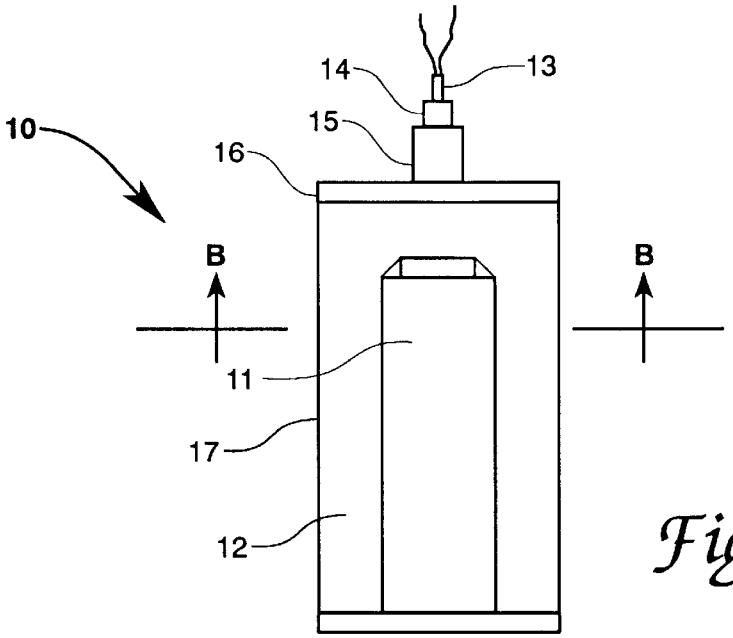
FIG 1*a* is a view in axial section of a representative charge configuration of the invention which was used for the first series of blast pressure arena tests in demonstration of the invention.
Figure 1B:
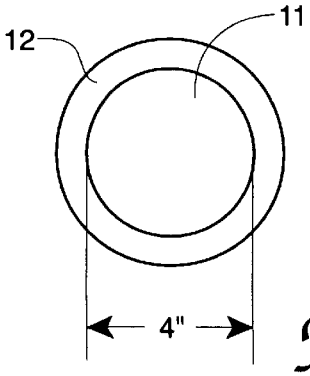
FIG 1*b* is a view of the FIG 1*a* charge configuration taken along line B–B.

Referring now to the drawings, FIGS. 1*a* and 1*b* show respective schematic axial sectional and a cross sectional views of a representative charge configuration according to the invention. The invention comprises a dual explosive charge 10 including an inner (driven) core 11 comprising a first explosive formulation surrounded by an outer layer or sleeve 12 comprising a second explosive formulation. It may be stated at the outset that though core 11 and sleeve 12 are herein described and depicted as having cylindrical shape, other geometrical shapes may be used, such as spherical, cubical and other, as would occur to the skilled artisan guided by these teachings within the scope of the claims. In accordance with a principal feature of the invention, core 11 may comprise a non-ideal explosive and sleeve 12 may comprise a more nearly ideal explosive. Accordingly, core 11 may comprise a non-ideal explosive containing an intermolecular composite mixture including fuels and/or oxidizers such as metal powders and/or oxidizers with a near stoichiometric blend of intra-molecular fuel ingredients. Preferred core 11 formulations may therefore include ammonium perchlorate (AP) and aluminum powder (AL) combined with trinitrotoluene (TNT) and/or a nitramine (RDX or HMX) with or without a polymeric HTPB/wax binder system, that is, such as CHEMCORE (26% TNT/37% AP/37% AL) or PBXN-111 (20% RDX/43% AP/25% AL12% wax binder) or PWX MOD 19 (25% RDX/30% AP/33% AL/12% wax binder. Sleeve 12 may comprise a more nearly ideal explosive including a nitramine-based explosive in an inert or energetic binder system, such as PBXN-110 (88% HMX/12% HTPB binder or COMP B (59.5% RDX/39.5% TNT/1% wax desensitizer). Detonation of the outer charge comprising sleeve 12 results in super-confinement and/or shock pressure over-driving of the explosive charge comprising core 11.

Core 11 and sleeve 12 may be of substantially any diametric size and length, the same not considered limiting of the invention. Explosive charges fabricated in the practice of the invention may typically have a core 11 having a diameter of from about 4 inches to about 12 inches, and sleeve 12 may have a thickness of from about ¾ to about 1½ inches. However, it should be noted that in a preferred arrangement where the dual charge of the invention is most effective, the ratio of the volume of core 11 to that of sleeve 12 is as large as possible, and preferably from about 0.75 to about 3.0. Factors which dictate the minimum thickness of sleeve 12 include failure diameter of the outer charge explosive formulation, containment material and thickness, and the confining pressure required to accelerate the reaction in the inner charge comprising core 11. The sleeve 12 explosive should have a higher (5–40%) detonation velocity than that of the core 11 formulation.

The dual explosive charge configuration of the invention may be prepared by casting and machining (if necessary) core 11 to the desired shape and dimensions, and placing core 11 concentrically within a tubular container of preselected size according to the outer dimension of sleeve 12. The sleeve 12 explosive is then cast around core 11 inside the container. It may be preferable to form core 11 with a slight taper in order to facilitate casting of the sleeve 12 explosive and to streamline the sleeve 12 detonation path.

A first series of blast pressure arena shot tests was conducted on explosive charges comprising substantially unconfined 7-inch diameter/16-inch long charges of PWX MOD 19, PBXN-110 and a dual explosive charge consisting of a 4-inch diameter core 11 of PWX MOD 19 surrounded by a sleeve 12 of PBXN-110. A schematic in axial section of the charge configuration for these tests is shown in FIG 1*a* and a cross section of a test charge 10 is shown in FIG 1*b*. In the tests, each test charge 10 was initiated using an RP-80 detonator 13, a 1-inch by 1-inch Comp A-5 pellet 14, a 2-inch diameter by 2-inch long Comp B booster 15, and a 7-inch diameter by 1-inch thick Comp B pad 16. Each dual explosive test charge 10 was contained in a thin 0.25 inch thick walled phenolic tube 17 which provided minimal confinement.

Figure 2A:
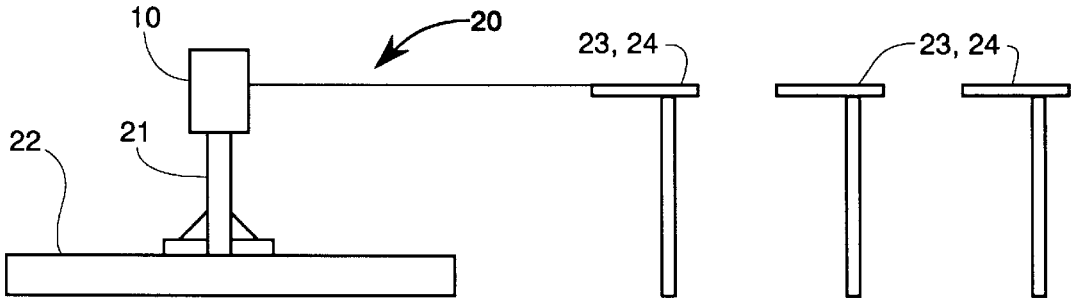
FIG. 2*a* shows schematically the test equipment arrangement for the blast pressure arena tests on the FIG 1*a*,1*b* charges.
Figure 2B:
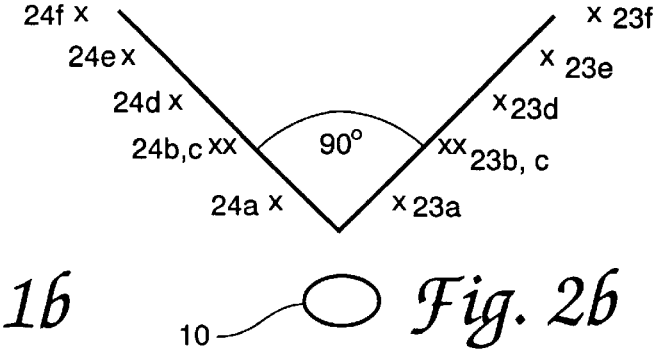
FIG. 2*b* shows the location of pressure transducers in the FIG. 2*a* test equipment arrangement.

FIG. 2*a* shows schematically the test equipment arrangement 20 for the blast pressure arena tests on test charges 10. Test charge 10 was positioned vertically on wooden stand 21 on center 51 inches above ground level. Stand 21 was mounted on base 22 of 6 feet×6 feet×4 inch thick, rolled homogeneous armor plate. Piezoelectric pressure sensor transducers 23*a–f*,24*a–f* were placed substantially as shown in FIG. 2*b* along two orthogonal gauge lines at 25, 35, 35.5, 45, 55 and 65 feet from and along the centerline height (51 inches) of test charge 10. Barometric pressure, wind speed and direction and temperature were recorded using on-site monitors. Pre- and post-test calibrations were performed for each shot.

Table 1 is a summary of blast pressure shot test performance data comparisons for the blast pressure arena tests, and show the peak pressure obtained for the dual explosive charge to be the same as that for PWX MOD 19. The impulse derived from the dual explosive charges was only 93% of that obtained for PWX MOD 19. The peak pressure and impulse from the dual explosive charge were 4% and 5% greater than those obtained from the PBXN-110 charge. Success criteria for the tests was maintaining the blast performance of PWX MOD 19.

Figure 3:
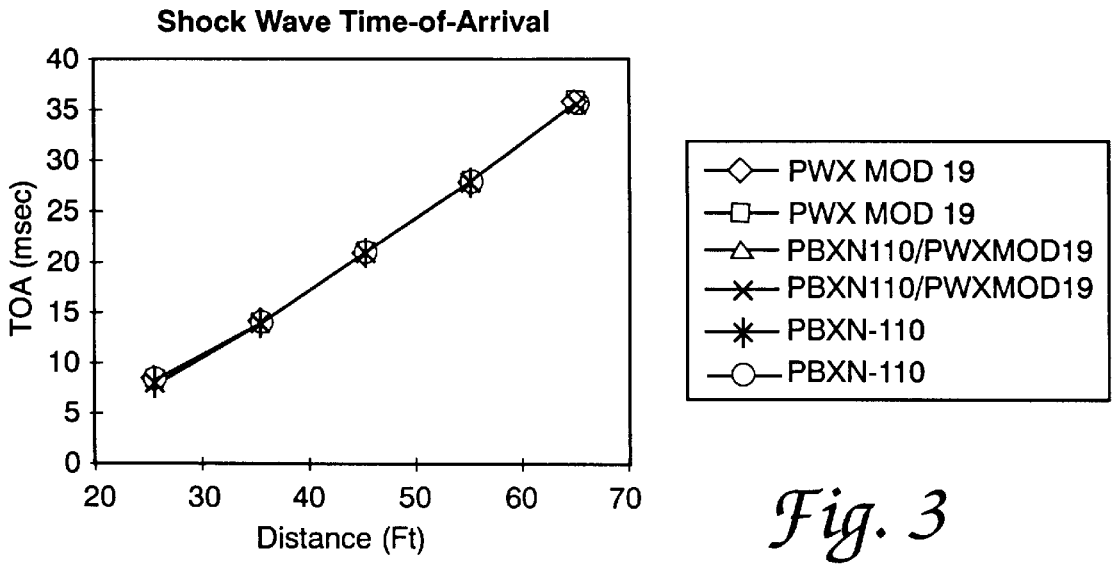
FIG. 3 shows graphs of shock wave time of arrival versus distance at each transducer position for blast pressure arena shot tests conducted in demonstration of the invention.
Figure 4:
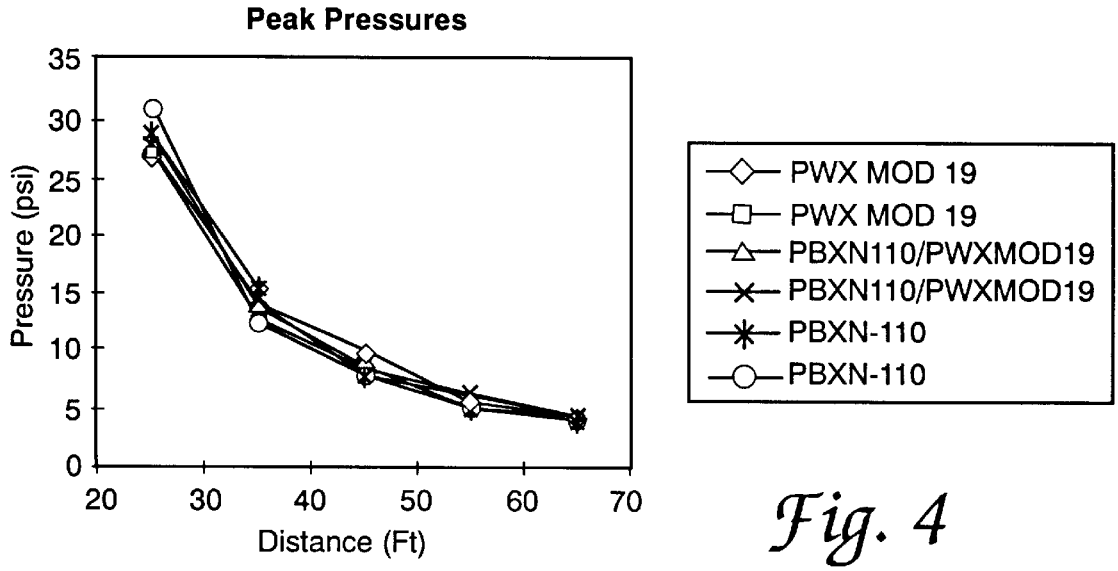
FIG. 4 shows graphs of peak pressure versus distance at each transducer position for blast pressure arena shot tests conducted in demonstration of the invention.
Figure 5:
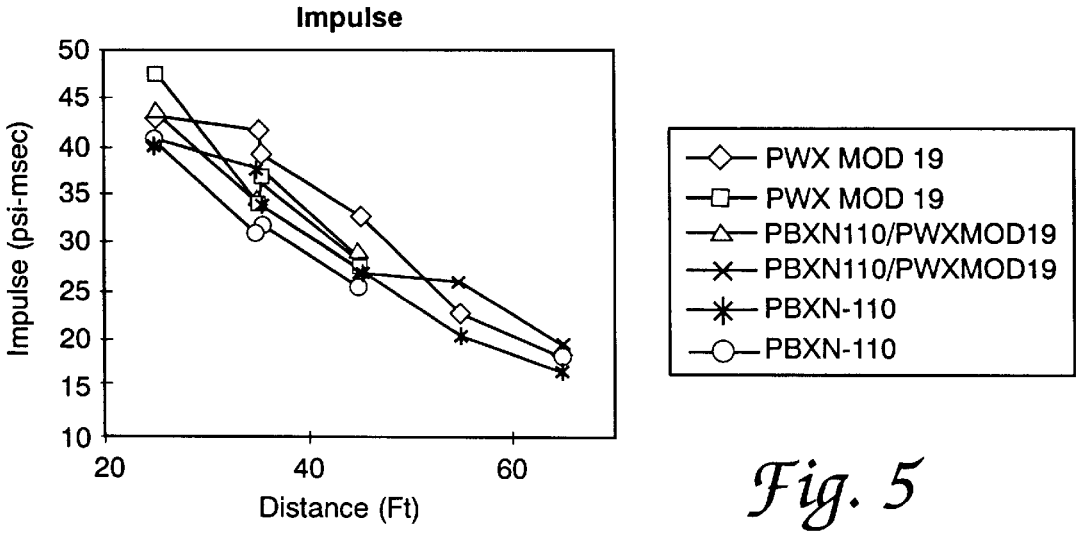
FIG. 5 shows graphs of impulse versus distance at each transducer position for blast pressure arena shot tests conducted in demonstration of the invention.
Figure 6:
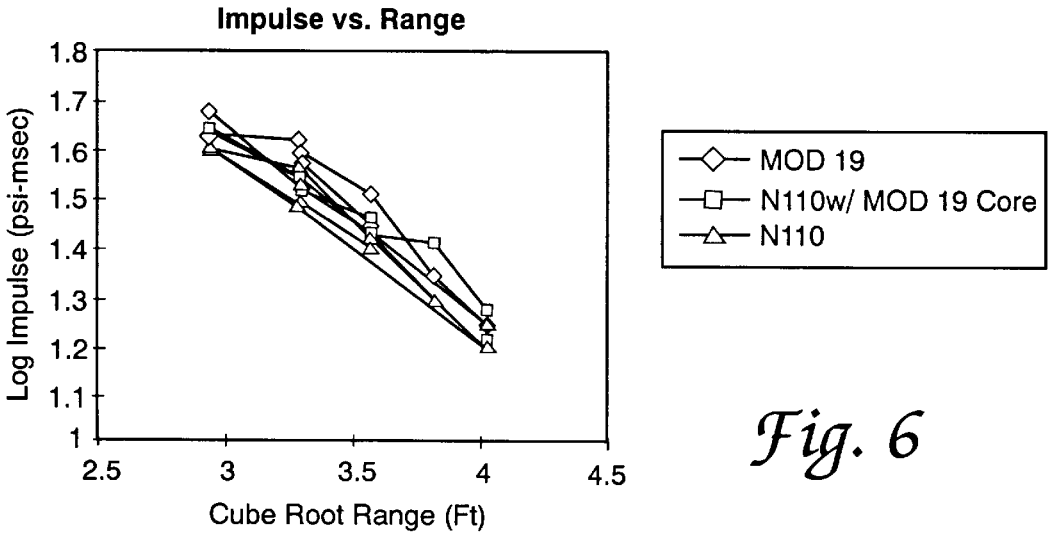
FIG. 6 shows graphs of log impulse versus cube root of distance from the test item at each transducer position for blast pressure arena shot tests conducted in demonstration of the invention.
Figure 7:
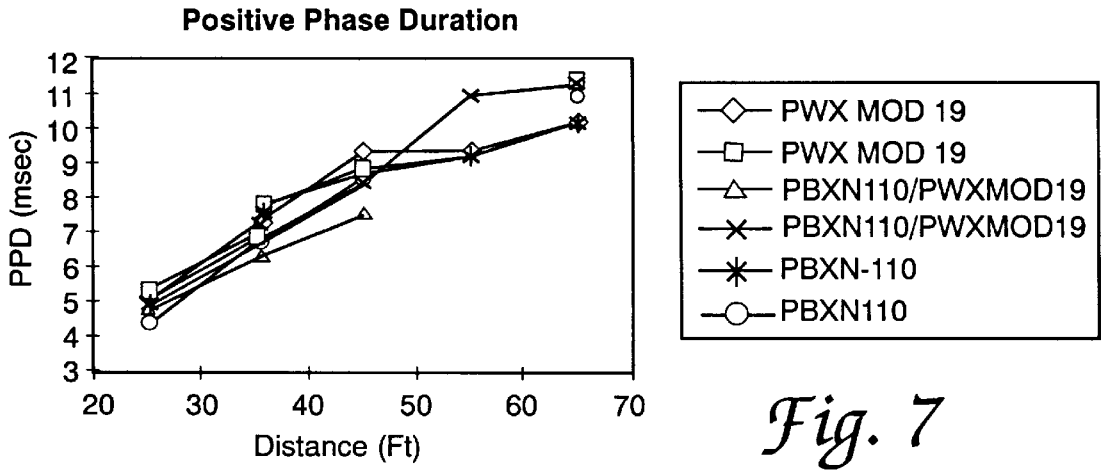
FIG. 7 shows graphs of shockwave positive phase duration versus distance at each transducer position for blast pressure arena shot tests conducted in demonstration of the invention.

Blast pressure data from individual shots are shown in Tables 2–4. Table 2 shows data from Shot 1 comprising 39.4 lbs of PWX MOD 19, shot conditions, temperature 75° F., barometric pressure 30.15 inches, wind 10 mph ENE. Table 3 shows data from Shot 2 comprising 36.03 lbs of PBXN-110 with PWX MOD 19 core, shot conditions, temperature 73° F., barometric pressure 30.08 inches, wind 11 mph ENE. Table 4 shows data from Shot 3 comprising 36.30 lbs of PBXN-110, shot conditions, temperature 73° F., barometric pressure 30.02 inches, wind 5 mph ESE. Blast pressure data at each transducer position are shown in FIGS. 3–7. FIG. 3 shows graphs of shock wave time of arrival versus distance. FIG. 4 shows graphs of peak pressure versus distance. FIG. 5 shows graphs of impulse versus distance. FIG. 6 shows graphs of log impulse versus cube root of distance from the test item. FIG 7 shows graphs of shockwave positive phase duration versus distance.

Table 1 and FIGS. 3–6 show that shockwave time-of-arrival does not discriminate between the three test charges. Peak pressures from the dual charge system were equivalent to those from the PWX Mod 19 charge. Both the dual charge 10 system and the PWX Mod 19 charge showed 4–5% enhancement of peak pressure relative to PBXN-110. Impulses measured for the dual charge 10 system were about 7% below those from the PWX Mod 19 charge. Impulses for the dual charge 10 system were 5% greater than those from PBXN-110 while those from PWX Mod 19 were 13% greater than PBXN-110. Positive phase durations yield the same ranking of the three charges.

The dual charge 10 of the invention provides a promising approach for increasing blast performance of an ordnance package while maintaining metal acceleration characteristics. The impulses measured for confined charges of PBXW-114 (78% HMX/10% AL/12% HTPB binder) were 18±0.0003% greater than those from PBXN-110 and 2 ±0.0003% greater than those from PBXN-109 (64% RDX/20% AL/16% HTPB binder).

Figure 8A:
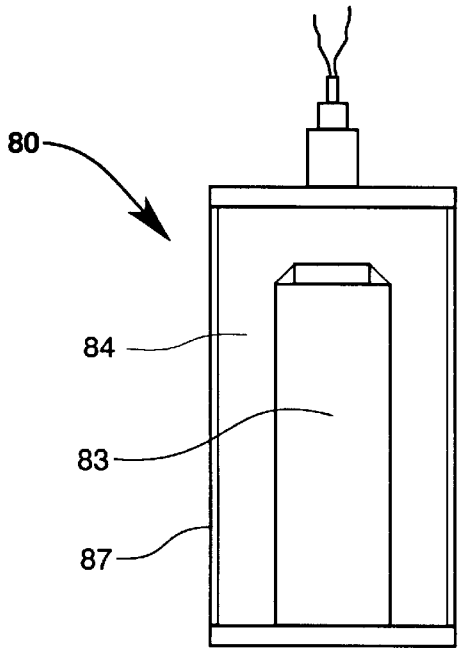
FIGS. 8*a* and 8*b* show schematic views in axial section of the test charge configurations for the subscale blast pressure/fragment velocity arena tests in demonstration of the invention.
Figure 8B:
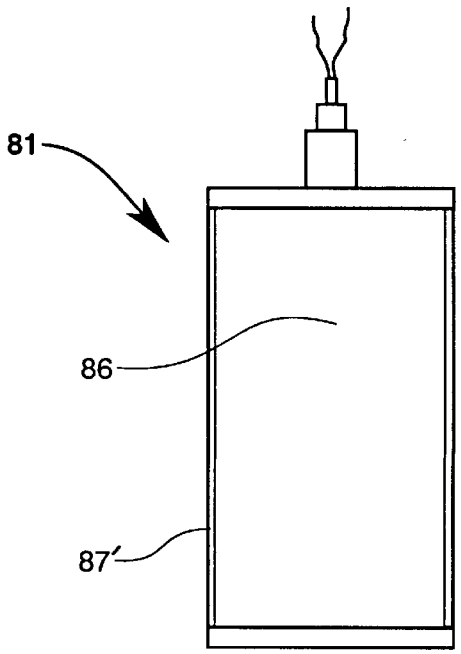

A series (13) of subscale blast pressure/fragment velocity arena test shots was conducted on seven explosive composition test charges 80,81 shown schematically in axial section in FIGS. 8*a* and 8*b*. Test item 80 comprised an inner four-inch diameter core 83 of PWX Mod 19 or CHEMCORE and a sleeve 84 of PBXN-110. Test charge 81 comprised an eight-inch diameter cylinder 86 of PWX MOD 19, PBXN-110, APET 257 (25% RDX/30% AP/33% AL/12% HTPB binder), APET 257-4 (25% ultrafine RDX/30% AP/33% AL/12% HTPB binder), or AFX-625 (25% HMX/25% NTO(3-nitro-1,2,4-triazol-5-one)/25% AL/25% TNT). Test charges 80,81 were encased in mild steel tubes 87,87' eight inches OD by 16 inches long and 0.5 inch wall thickness. It is noted that the inner core charge may also be enclosed in a metal tube to provide additional confinement of the inner charge and additional metal mass to be projected upon detonation. The formulations used are shown in Table 5 and air blast fragmentation velocity performance rankings for the tests are shown in Table 6. In the tests, each test charge was initiated using an RP-80 detonator, 1-inch by 1-inch Comp A-5 pellet, 2-inch diameter by 2-inch long Comp B booster, and 7-inch diameter by 1-inch thick Comp B pad similarly to the blast pressure arena tests described above.

Figure 9:
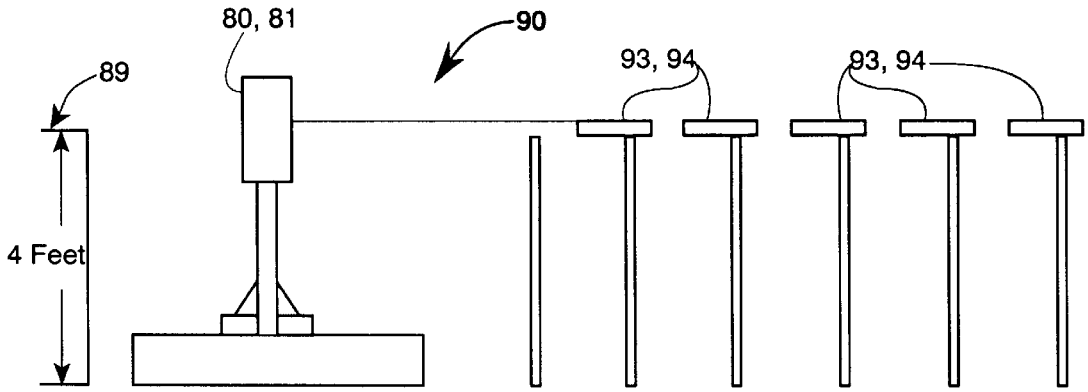
FIG. 9 shows schematically the test equipment arrangement for the blast pressure/fragment velocity tests on the FIGS. 8*a*,8*b* test items.

FIG. 9 shows schematically test equipment arrangement 90 for the blast pressure/fragment velocity tests. Each test item 80,81 was positioned vertically on center 6 feet above ground level on a wooden stand 91 mounted on base 92 of 6 feet×6 feet ×4-inch thick, rolled homogeneous armor plate. Piezoelectric pressure sensors 93*a–f*,94*a–f* were placed similarly to sensors 23,24 of FIG. 2*b* along the centerline height (six feet) of test items 80,81. In addition, two fragment velocity screens 89 were placed 34 feet behind the test items substantially as shown in FIG. 9, and a one-foot high ricochet fence (not shown in the drawings) consisting of sandbags was positioned 25 feet from the test charges. Weather data (temperature, dew point, wind direction/speed, relative humidity, barometric pressure) were monitored and recorded.

Figure 10:
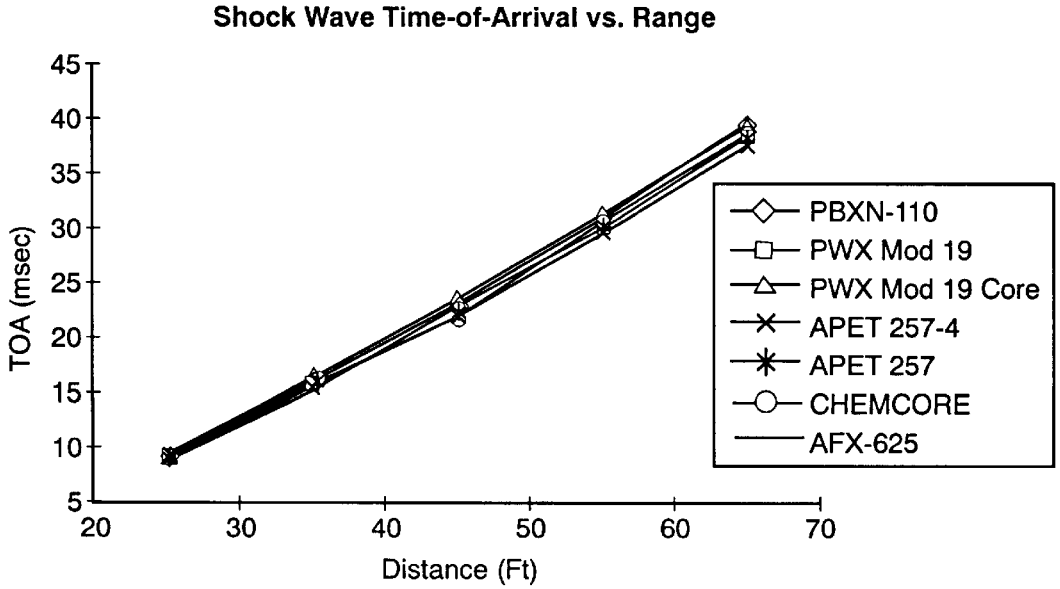
FIG. 10 shows graphs of shock wave time of arrival versus distance at each sensor position for the blast pressure/fragmentation velocity tests conducted in demonstration of the invention.
Figure 11:
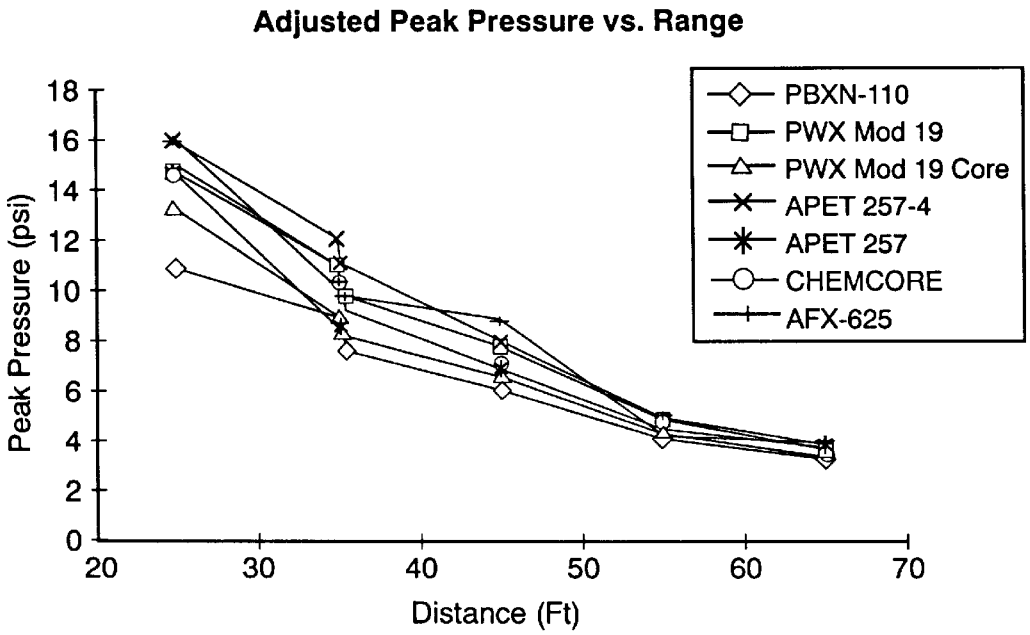
FIG. 11 shows graphs of peak pressure versus distance at each sensor position for the blast pressure/fragmentation velocity tests conducted in demonstration of the invention.
Figure 12:
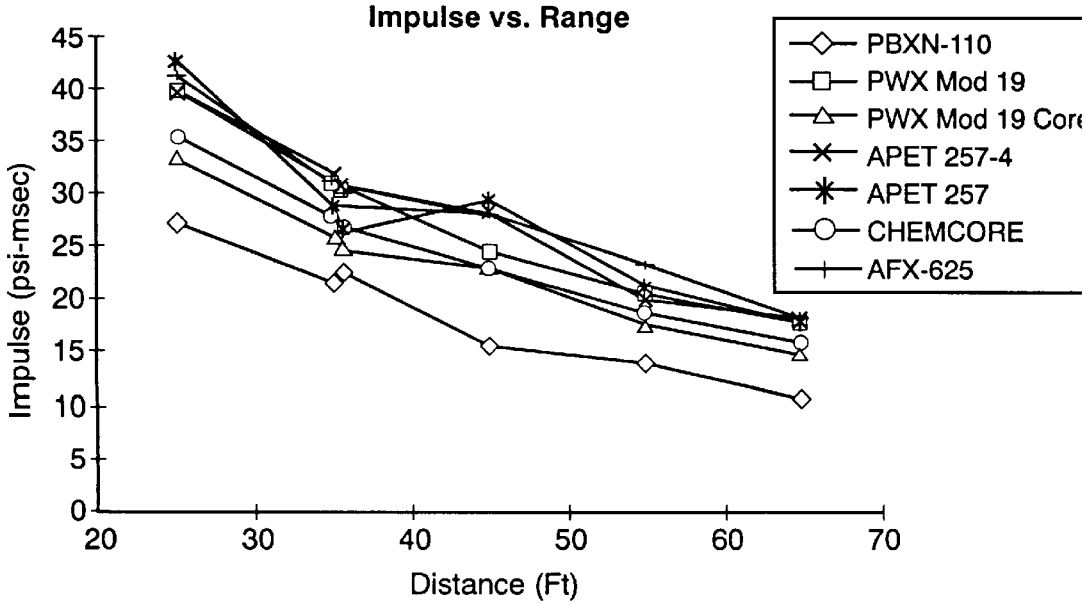
FIG. 12 shows graphs of impulse versus distance at each sensor position for the blast pressure/fragmentation velocity tests conducted in demonstration of the invention.
Figure 13:
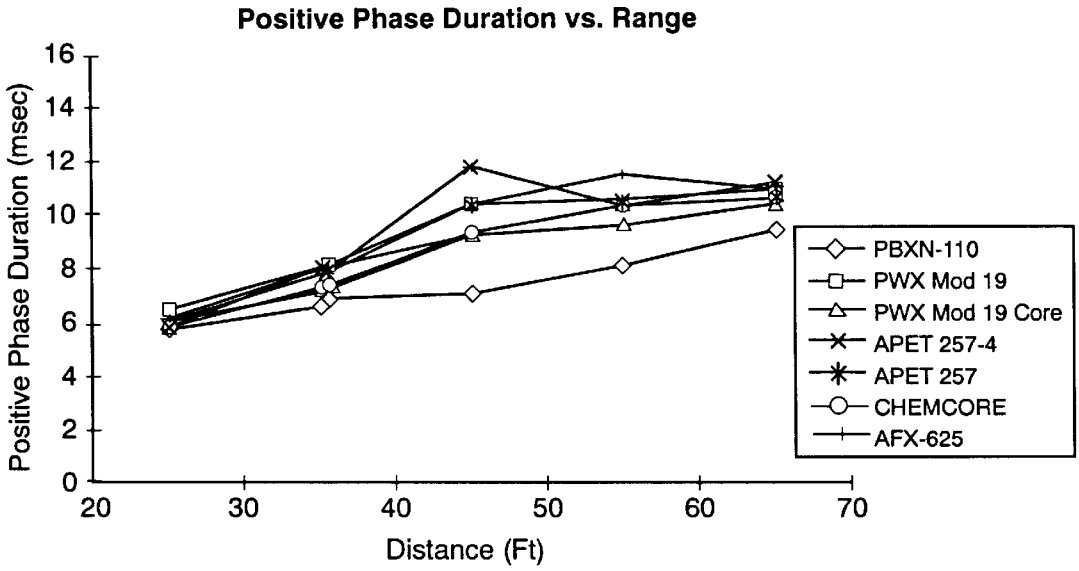
FIG. 13 shows graphs of positive phase duration versus distance at each sensor position for the blast pressure/fragmentation velocity tests conducted in demonstration of the invention.

Air blast and fragmentation velocity data from individual shots are shown in Tables 7–10. Data from each sensor position are shown in FIGS. 10–13. FIG. 10 shows graphs of shock wave time of arrival versus distance. FIG. 11 shows graphs of peak pressure versus distance. FIG. 12 shows graphs of impulse versus distance. FIG. 13 shows graphs of positive phase duration versus distance.

Figure 14:
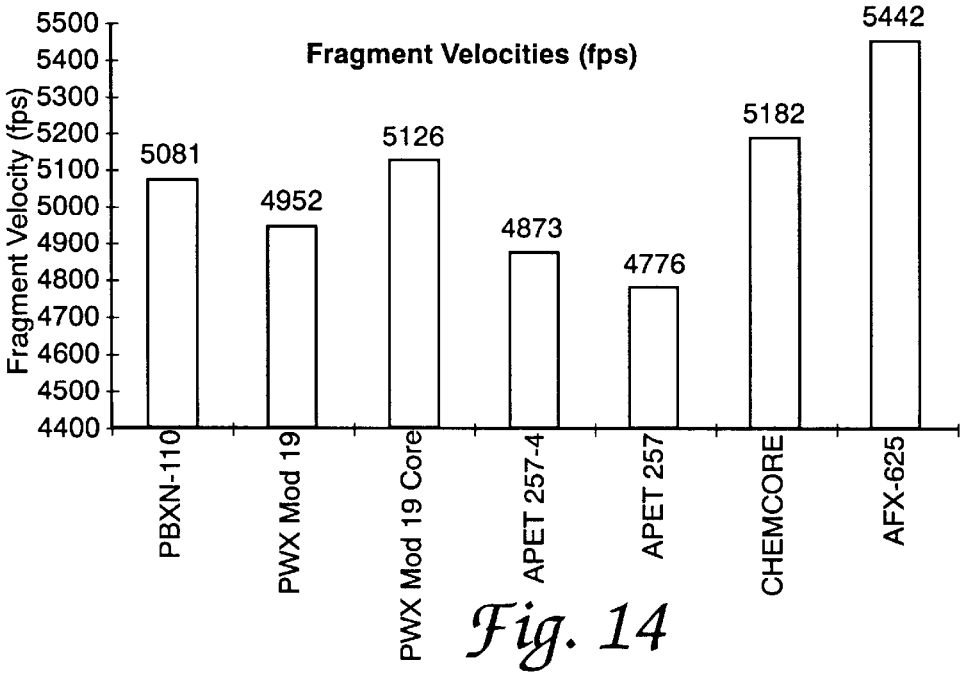
FIG. 14 shows charts of average fragment velocity for each formulation used in demonstration of the invention.

The weighted, average fragment velocity and velocity range for each formulation/configuration is shown in FIG. 14 and Table 11. Of the formulations tested in this series, AFX-625 generated the highest velocity fragments and superior air blast characteristics. The dual explosive charges accelerated the fragments to a higher velocity than the PBXN-110 charges. The results suggested that the ratio of non-ideal to ideal explosive must be large. (The PBXN-110 used in the test series herein contained HMX ground to 2 microns, which meets the specification for PBXN-110, but restricting the HMX particle size distribution in this manner could influence both performance and sensitivity characteristics). The dual explosive charges with a core of PWX Mod 19 and a shell of PBXN-110 provided enhanced fragment velocities relative to PWX Mod 19 alone. The dual explosive charges provided improved airblast characteristics when compared to PBXN-110. However, in the case of the PWX Mod 19 core charge with the PBXN-110 shell, the charge failed to achieve the airblast characteristics of PWX Mod 19 alone. This energy enhancement may contribute to the improved fragment velocities observed for the dual explosive charges, however, it did not result in enhanced air blast characteristics. The CHEMCORE composition was developed to maximize the AP/Al available in an energetic binder system, and in every instance outperformed the PWX Mod 19 Core charge of the same dimensions.

The invention therefore provides a dual explosive charge formulation and configuration for enhancing blast pressure and fragmentation in a munition. It is understood that modifications to the invention may be made as might occur to one with skill in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

TABLE 1

| Parameter | Dual Charge/ PWX Mod 19 | Dual charge/ PBXN-110 | PWX Mod 19/ PBXN-110 |
|---|---|---|---|
| Shockwave Time of Arrival Ratios | 1.00 ± 0.00 | 1.00 ± 0.01 | 1.01 ± 0.01 |
| Peak Pressure Ratios | 1.00 ± 0.07 | 1.04 ± 0.10 | 1.05 ± 0.11 |
| Impulse Ratios | 0.93 ± 0.07 | 1.05 ± 0.07 | 1.13 ± 0.05 |
| Positive Phase Duration Ratios | 0.93 ± 0.06 | 0.97 + 0.09 | 1.04 ± 0.08 |

TABLE 2

| Gauge | Distance (ft) | Time of Arrival (msec) | Peak Pressure (psi) | Impulse (psi-msec) | Positive Phase Duration (msec) |
|---|---|---|---|---|---|
| 1 | 25 | 7.81 | 26.95 | 42.79 | 5.13 |
| 2 | 35 | 13.80 | 15.50 | 41.60 | 6.89 |
| 3 | 35.5 | 14.13 | 13.64 | 39.16 | 7.42 |
| 4 | 45 | 20.65 | 10.01 | 32.57 | 9.34 |
| 5 | 55 | 27.98 | 5.50 | 22.25 | 9.31 |
| 6 | 65 | 35.72 | 4.20 | 17.77 | 10.11 |
| 7 | 25 | 7.81 | 27.40 | 47.57 | 5.40 |
| 8 | 35 | 13.80 | 12.22 | 33.96 | 7.05 |
| 9 | 35.5 | 14.13 | 12.94 | 37.04 | 7.88 |
| 10 | 45 | 20.65 | 8.17 | 27.89 | 8.90 |
| 11 | 55 | 27.98 | | | |
| 12 | 65 | 35.72 | | | 11.30 |

TABLE 3

| Gauge | Distance (ft) | Time of Arrival (msec) | Peak Pressure (psi) | Impulse (psi-msec) | Positive Phase Duration (msec) |
|---|---|---|---|---|---|
| 1 | 25 | 7.75 | 28.52 | 43.68 | 4.92 |
| 2 | 35 | 13.66 | 14.01 | 35.00 | 6.41 |
| 3 | 35.5 | 14 | 12.19 | 32.81 | 6.39 |
| 4 | 45 | 20.5 | 9.34 | 29.1 | 7.62 |
| 5 | 55 | 27.83 | | | |

TABLE 3-continued

| Gauge | Distance (ft) | Time of Arrival (msec) | Peak Pressure (psi) | Impulse (psi-msec) | Positive Phase Duration (msec) |
|---|---|---|---|---|---|
| 6 | 65 | 35.6 | 4.22 | 16.45 | 10.10 |
| 7 | 25 | 7.77 | 28.15 | | 5.09 |
| 8 | 35 | 13.84 | 13.29 | 33.57 | 6.92 |
| 9 | 35.5 | 14.17 | 13.61 | 35.81 | 6.84 |
| 10 | 45 | 20.80 | 8.44 | 26.62 | 8.44 |
| 11 | 55 | 28.22 | 6.25 | 25.68 | 10.94 |
| 12 | 65 | 36.01 | 4.24 | 18.97 | 11.28 |

TABLE 4

| Gauge | Distance (ft) | Time of Arrival (msec) | Peak Pressure (psi) | Impulse (psi-msec) | Positive Phase Duration (msec) |
|---|---|---|---|---|---|
| 1 | 25 | 7.62 | 28.73 | 40.29 | 5.13 |
| 2 | 35 | 16.51 | 15.47 | 37.32 | 7.25 |
| 3 | 35.5 | 13.85 | 13.00 | 34.04 | 7.8 |
| 4 | 45 | 20.45 | 7.66 | 26.59 | 8.76 |
| 5 | 55 | 27.94 | 4.89 | 19.97 | 9.18 |
| 6 | 65 | 35.86 | 3.86 | 15.98 | 10.16 |
| 7 | 25 | 7.87 | 30.98 | 40.65 | 4.46 |
| 8 | 35 | 13.77 | 12.40 | 30.80 | 6.81 |
| 9 | 35.5 | 14.10 | 12.32 | 31.69 | 6.78 |
| 10 | 45 | 20.70 | 7.72 | 25.14 | 8.61 |
| 11 | 55 | | | | |
| 12 | 65 | 35.96 | 4.04 | 17.84 | 10.93 |

TABLE 5

| Designation | Composition/Configuration |
|---|---|
| PBXN-110 (2 micron HMX)-2 shots | HMX/HTPB (88/12) |
| PWX Mod 19-2 shots | Polywax/Al/AP/RDX (12/33/30/25) |
| PWX Mod 19 Core/PBXN-110 Shell-2 shots | 4.5-inch Diameter Core of PWX Mod 19 Surrounded by PBXN-110 (See FIG. 8a) |
| APET 257-4-2 shots | HTPB/RDX/AP/Al (12/25/30/33), 4 micron RDX |
| APET 257-1 shot | HTPB/RDX/AP/Al (12/25/30/33), Class V RDX |
| CHEMCORE/PBXN-110 Shell-2 shots | 4.5-inch Diameter Core of CHEMCORE TNT/AP/Al (26/37/37), Surrounded by PBXN-110 (see FIG. 8a) |
| AFX-625-2 shots | TNT/HMX/NTO/Al (25/25/25/25) |

TABLE 6

| Performance | Ranking |
|---|---|
| Peak Pressure | APET 257-4 > AFX-625 > PWX Mod 19 > CHEMCORE > APET 257 > PWX Mod 19 Core > PBXN-110 |
| Impulse | AFX-625 > APET 257-4 > APET 257 > PWX Mod 19 > CHEMCORE > PWX Mod 19 Core > PBXN-110 |
| Shockwave Velocity | AFX-625 > APET 257-4 > APET 257 > PBXN-110 > CHEMCORE > PWX Mod 19 > PWX Mod 19 Core |
| Positive Phase Duration | AFX-625 > APET 257-4 > APET 257 > PWX Mod 19 > CHEMCORE > PWX Mod 19 Core > PBXN-110 |
| Fragment Velocity | AFX-625 > CHEMCORE > PWX Mod 19 Core > PBXN-110 > PWX Mod 19 > APET 257-4 > APET 257 |

TABLE 7

| Distance (feet) | PBXN-110 | PWX Mod 19 | PWX Mod 19 Core | APET 257-4 | APET 257 | CHEM-CORE | AFX-625 |
|---|---|---|---|---|---|---|---|
| 25 | 9.02 ± 1.18 | 9.40 ± 9.40 | 9.73 ± 0.19 | 9.37 ± 0.08 | 9.56 ± 0.11 | 9.55 ± 0.09 | 9.09 ± 0.11 |
| 35 | 16.19 ± 2.01 | 16.23 ± 0.16 | 46.59 ± 0.20 | 15.57 ± 0.51 | 15.54 | 16.28 ± 0.15 | 15.74 ± 0.14 |
| 35.5 | 16.40 ± 2.06 | 16.55 ± 0.16 | 17.00 ± 0.18 | 16.26 ± 0.14 | 16.33 | 16.55 ± 0.21 | 15.88 ± 0.21 |
| 45 | 21.91 ± 3.28 | 23.34 ± 0.28 | 23.96 ± 0.10 | 22.86 ± 0.11 | 22.84 ± 0.17 | 22.93 ± 0.76 | 22.21 ± 0.92 |
| 55 | 31.25 ± 1.28 | 30.91 ± 0.15 | 31.64 ± 0.08 | 30.18 ± 0.61 | 30.77 ± 0.23 | 31.07 ± 0.02 | 29.68 ± 0.67 |
| 65 | 39.66 ± 1.29 | 38.77 ± 0.10 | 39.55 ± 0.15 | 38.36 ± 0.12 | 38.70 ± 0.31 | 38.70 ± 0.19 | 37.68 ± 0.06 |

TABLE 8

| Distance (feet) | PBXN-110 | PWX Mod 19 | PWX Mod 19 Core | APET 257-4 | APET 257 | CHEM-CORE | AFX-625 |
|---|---|---|---|---|---|---|---|
| 25 | 10.94 ± 0.75 | 14.82 ± 2.30 | 13.38 ± 1.85 | 16.01 ± 2.58 | 14.64 ± 1.31 | 14.60 ± 2.69 | 15.93 ± 2.11 |
| 35 | 8.96 ± 1.77 | 10.96 ± 0.82 | 9.12 ± 1.53 | 11.96 ± 2.09 | 8.44 | 10.21 ± 1.11 | 10.14 ± 2.32 |
| 35.5 | 7.55 ± 0.82 | 9.70 ± 0.41 | 8.25 ± 0.40 | 10.88 ± 1.09 | 9.09 | 9.10 ± 0.32 | 9.69 ± 0.87 |
| 45 | 5.87 ± 1.86 | 7.60 ± 0.76 | 6.48 ± 1.46 | 7.84 ± 0.40 | 6.80 ± 0.33 | 6.95 ± 0.46 | 8.63 ± 3.97 |
| 55 | 3.79 ± 0.44 | 4.68 ± 0.51 | 4.13 ± 0.52 | 4.66 ± 0.17 | 4.16 ± 0.37 | 4.50 ± 0.10 | 3.97 ± 1.25 |
| 65 | 2.88 ± 0.67 | 3.51 ± 0.38 | 3.10 ± 0.56 | 3.61 ± 0.26 | 3.50 ± 0.58 | 3.16 ± 0.19 | 3.69 ± 0.01 |

TABLE 9

| Distance (feet) | PBXN-110 | PWX Mod 19 | PWX Mod 19 Core | APET 257-4 | APET 257 | CHEM-CORE | AFX-625 |
|---|---|---|---|---|---|---|---|
| 25 | 27.09 ± 2.77 | 39.74 ± 0.79 | 33.19 ± 1.11 | 39.57 ± 1.04 | 42.60 ± 0.21 | 35.48 ± 0.83 | 41.18 ± 2.63 |
| 35 | 21.40 ± 0.42 | 30.68 ± 1.43 | 25.77 ± 1.79 | 31.83 ± 4.15 | 29.82 | 27.72 ± 1.17 | 30.89 ± 2.89 |
| 35.5 | 22.42 ± 1.39 | 30.16 ± 2.81 | 26.36 ± 0.57 | 30.42 ± 1.63 | 26.32 | 26.60 ± 0.60 | 28.59 ± 0.70 |

TABLE 9-continued

| Distance (feet) | PBXN-110 | PWX Mod 19 | PWX Mod 19 Core | APET 257-4 | APET 257 | CHEM-CORE | AFX-625 |
|---|---|---|---|---|---|---|---|
| 45 | 15.26 ± 5.65 | 24.26 ± 0.91 | 22.89 ± 2.32 | 27.60 ± 3.32 | 29.17 ± 6.72 | 22.72 ± 6.21 | 27.85 ± 5.75 |
| 55 | 13.71 ± 1.30 | 20.44 ± 0.76 | 17.32 ± 0.16 | 19.48 ± 0.35 | 20.91 ± 0.11 | 18.47 ± 0.39 | 23.02 ± 3.96 |
| 65 | 10.24 ± 3.64 | 17.35 ± 0.93 | 14.35 ± 0.65 | 17.65 ± 0.73 | 17.43 ± 1.17 | 15.50 ± 0.44 | 17.77 ± 0.19 |

TABLE 10

| Distance (feet) | PBXN-110 | PWX Mod 19 | PWX Mod 19 Core | APET 257-4 | APET 257 | CHEM-CORE | AFX-625 |
|---|---|---|---|---|---|---|---|
| 25 | 5.73 ± 0.38 | 6.51 ± 0.34 | 5.91 ± 0.49 | 6.07 ± 0.18 | 5.76 ± 0.50 | 5.78 ± 0.53 | 6.20 ± 0.80 |
| 35 | 6.58 ± 0.56 | 7.75 ± 0.63 | 7.09 ± 0.41 | 7.98 ± 1.41 | 8.02 | 7.33 ± 0.21 | 8.04 ± 0.71 |
| 35.5 | 6.88 ± 0.17 | 8.15 ± 1.77 | 7.17 ± 0.58 | 7.86 ± 0.77 | 7.89 | 7.40 ± 0.17 | 7.87 ± 0.65 |
| 45 | 7.07 ± 0.40 | 9.24 ± 0.06 | 9.27 ± 1.28 | 10.32 ± 1.88 | 11.77 ± 4.12 | 9.30 ± 0.45 | 10.33 ± 3.12 |
| 55 | 8.06 ± 0.43 | 10.33 ± 0.44 | 9.53 ± 0.37 | 10.52 ± 0.50 | 10.25 ± 0.69 | 10.20 ± 0.24 | 11.40 ± 1.35 |
| 65 | 9.39 ± 0.25 | 10.83 ± 0.83 | 10.28 ± 0.71 | 11.18 ± 0.49 | 10.48 ± 1.08 | 10.96 ± 0.76 | 10.82 ± 0.23 |

TABLE 11

| Formulation/ Configuration | Velocity Range (fps) | Average Number of Hits per Screen |
|---|---|---|
| PBXN-110 | 4843–6317 | 16 |
| PWX Mod 19 | 4752–5504 | 12 |
| PWX Mod 19 Core | 4388–5820 | 14 |
| APET 257-4 | 3750–5426 | 11 |
| APET 257 | 3032–5395 | 11 |
| CHEMCORE | 4012–5641 | 13 |
| AFX-625 | 3864–6148 | 15 |

We claim:

1. A dual explosive charge for enhancing blast pressure and fragmentation in a munition, comprising:

(a) an inner charge of a first explosive formulation; and (b) a outer layer of a second explosive formulation surrounding said inner charge, said second explosive formulation having a detonation velocity greater than that of said first explosive formulation, whereby detonation of the outer charge results in a high temperature, high pressure environment that accelerates reaction kinetics in the inner charge.

2. The explosive charge of claim 1 wherein said first explosive formulation comprises ammonium perchlorate and aluminum powder combined with trinitrotoluene or a nitramine and a wax binder.

3. The explosive charge of claim 2 wherein said first explosive formulation consists essentially of 26% trinitrotoluene/37% ammonium perchlorate/37% aluminum powder, or 20% RDX nitramine/43ammonium perchlorate/25% aluminum powder/12% wax binder, or 25% RDX nitramine/30% ammonium perchlorate/33% aluminum powder/12% wax binder.

4. The explosive charge of claim 1 wherein said second explosive formulation is a nitramine-based explosive in a binder.

5. The explosive charge of claim 4 wherein said second explosive formulation consists essentially of 88% HMX nitramine/12% HTPB binder or 59.5% RDX nitramine/39.5% trinitrotoluene/1% wax.

6. The explosive charge of claim 1 wherein said inner charge has a diameter of from about 4 to about 12 inches and said outer layer has a thickness of from about ¾ to about 1½ inches.

7. The explosive charge of claim 1 wherein the ratio of the volume of said inner charge to that of said outer layer is in the range of about 0.75 to about 3.0.

8. The explosive charge of claim 1 wherein said second explosive formulation has a detonation velocity about 5% to 40% greater than that of said first explosive formulation.

9. A dual explosive charge for enhancing blast pressure and fragmentation in a munition, comprising:

(a) an inner charge of a first explosive formulation consisting essentially of 26% trinitrotoluene/37% ammonium perchlorate/37% aluminum powder, or 20% RDX nitramine/43% ammonium perchlorate/25% aluminum powder/12% wax binder, or 25% RDX nitramine/30% ammonium perchlorate/33% aluminum powder/12% wax binder; and (b) a outer layer of a second explosive formulation surrounding said inner charge, said second explosive formulation consisting essentially of 88% HMX nitramine/12% HTPB binder or 59.5% RDX nitramine/39.5% trinitrotoluene/1% wax and having a detonation velocity greater than that of said first explosive formulation, whereby detonation of the outer charge results in a high temperature, high pressure environment that accelerates reaction kinetics in the inner charge.

10. The explosive charge of claim 9 wherein said inner charge has a diameter of from about 4 to about 12 inches and said outer layer has a thickness of from about ¾ to about 1½ inches.

11. The explosive charge of claim 9 wherein the ratio of the volume of said inner charge to that of said outer layer is in the range of about 0.75 to about 3.0.

12. The explosive charge of claim 9 wherein said second explosive formulation has a detonation velocity about 5% to 40% greater than that of said first explosive formulation.

13. A fragmentation munition having enhanced blast pressure and fragmentation, comprising:

(a) an inner charge of a first explosive formulation consisting essentially of 26% trinitrotoluene/37% ammonium perchlorate/37% aluminum powder, or 20% RDX nitramine/43% ammonium perchlorate/25% aluminum powder/12% wax binder, or 25% RDX nitramine/30% ammonium perchlorate/33% aluminum powder/12% wax binder; and (b) a outer layer of a second explosive formulation surrounding said inner charge, said second explosive formulation consisting essentially of 88% HMX nitramine/12% HTPB binder or 59.5% RDX nitramine/39.5% trinitrotoluene/1% wax and having a detonation velocity of about 5% to 40% greater than that of said first explosive formulation, whereby detonation of the outer charge results in a high temperature, high pressure environment that accelerates reaction kinetics in the inner charge and enhanced fragmentation velocities and blast pressure.

14. The munition of claim 13 wherein said inner charge has a diameter of from about 4 to about 12 inches and said outer layer has a thickness of from about ¾ to about 1½ inches.

15. The munition of claim 13 wherein the ratio of the volume of said inner charge to that of said outer layer is in the range of about 0.75 to about 3.0.

* * * * *